US010105277B2

(12) United States Patent
Chong

(10) Patent No.: US 10,105,277 B2
(45) **Date of Patent: *Oct. 23, 2018**

(54) STRAP FOR INVERSION THERAPY TABLE

(71) Applicant: On Chong, Sunnyvale, CA (US)

(72) Inventor: On Chong, Sunnyvale, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/088,788

(22) Filed: Apr. 1, 2016

(65) Prior Publication Data

US 2017/0112704 A1 Apr. 27, 2017

Related U.S. Application Data

(60) Provisional application No. 62/245,157, filed on Oct. 22, 2015.

(51) Int. Cl.
*A63B 26/00* (2006.01)
*A61H 1/02* (2006.01)
(Continued)

(52) U.S. Cl.
CPC ..... *A61H 1/0229* (2013.01); *A61G 13/009* (2013.01); *A61G 13/04* (2013.01); *A61G 13/122* (2013.01); *A61G 13/125* (2013.01); *A61H 2201/0192* (2013.01); *A61H 2201/1284* (2013.01); *A61H 2201/169* (2013.01); *A61H 2201/1614* (2013.01); *A61H 2201/1619* (2013.01); *A61H 2201/1628* (2013.01);
(Continued)

(58) Field of Classification Search
CPC ..... A61H 1/0229; A61H 2201/0192; A61H 2201/1284; A61H 2201/1619; A61H 2201/1614; A61H 2201/1642; A61H 2201/1652; A61H 2201/169; A61H 2201/1628; A61H 2203/0493; A61G 13/122; A61G 13/04; A61G 13/009; A61G 13/125; A63B 21/02–21/028; A63B 21/05–21/0557
USPC ..... 482/121–126, 142–147
See application file for complete search history.

(56) References Cited

U.S. PATENT DOCUMENTS 3,561,434 A * 2/1971 Kilbey ..... A61F 5/24 602/36
4,865,022 A * 9/1989 Gorsen ..... A61H 1/0218 602/33
(Continued)

OTHER PUBLICATIONS

TruBalance Synergy NL Pro Deluxe Inversion Table; Amazon.com: Customer Reviews: http://www.amazon.com/TruBalance-Synergy-Deluxe-Inversion-Table/product-reviews/BOOT.
(Continued)

*Primary Examiner* — Garrett Atkinson

(57) ABSTRACT

A strap for a table having a backrest with a first end and a second end. The strap has a first end and a second end, wherein the first end of the strap is connected to the first end of the table backrest and the second end of the strap is connected to the middle portion of the second end of the table backrest. The strap provides a safety measure in the event the user shifts or slips when using the table. When used on an inversion therapy table, the strap may also enable the user to relieve pressure applied to the ankles and lower legs during inversion therapy. The strap may further include a length adjuster to fit the size of each individual user as well as visual length markers to indicate the adjustment settings for the strap.

13 Claims, 3 Drawing Sheets

(51) Int. Cl.
*A61G 13/00* (2006.01)
*A61G 13/04* (2006.01)
*A61G 13/12* (2006.01)

(52) U.S. Cl.
CPC ..... *A61H 2201/1642* (2013.01); *A61H 2201/1652* (2013.01); *A61H 2203/0493* (2013.01)

(56) References Cited

U.S. PATENT DOCUMENTS 5,207,627 A * 5/1993 Doran ..... A61H 1/0218 482/114
5,637,079 A * 6/1997 Miller ..... A61H 1/0218 601/23
5,772,622 A * 6/1998 Friske ..... A61H 1/0218 428/99
5,807,218 A * 9/1998 Nagatomo ..... A61F 5/3715 128/869
5,951,443 A * 9/1999 Askins ..... A63B 23/047 482/124
6,213,923 B1 * 4/2001 Cameron ..... A63B 21/012 297/50
7,044,896 B2 * 5/2006 Hetrick ..... A63B 21/00043 482/114
7,282,039 B2 * 10/2007 Henke ..... A61F 5/04 602/32
7,546,809 B2 6/2009 Chen
7,597,656 B2 * 10/2009 Trees ..... A61H 1/0229 482/142
7,722,508 B2 * 5/2010 Hetrick ..... A63B 21/00043 482/139
7,857,741 B1 12/2010 Hsiung
7,887,499 B2 * 2/2011 Cogswell ..... A61F 5/3715 602/23
7,955,236 B2 * 6/2011 DiGiovanni ..... A63B 21/0552 482/124
8,043,197 B2 * 10/2011 Hetrick ..... A63B 21/0023 482/904
8,062,198 B2 * 11/2011 Wei ..... A61H 1/0218 482/144
8,539,621 B2 * 9/2013 West ..... A61F 5/3776 5/621
8,556,787 B2 * 10/2013 Leier ..... A61H 1/0222 482/144
8,601,623 B1 * 12/2013 West ..... A61F 5/3776 5/621
8,721,509 B1 * 5/2014 Berdut-Teruel ..... A63B 21/068 482/121
8,944,976 B2 * 2/2015 Crowell ..... A63B 21/0442 482/121
9,216,311 B2 * 12/2015 Champion ..... A63B 21/151
9,433,550 B2 * 9/2016 Winternheimer ..... A61H 1/005
2003/0114275 A1 * 6/2003 Falbo, Sr. ..... A63B 21/4011 482/57
2003/0195092 A1 * 10/2003 Basting ..... A63B 21/0552 482/124
2006/0161084 A1 * 7/2006 Henke ..... A61F 5/04 602/32
2006/0178607 A1 * 8/2006 Evans ..... A61F 5/3776 602/33
2008/0177211 A1 * 7/2008 Boren ..... A61H 1/0218 602/32
2009/0054216 A1 * 2/2009 Teeter ..... A61H 1/0218 482/144
2009/0054217 A1 * 2/2009 Teeter ..... A61H 1/0218 482/144
2013/0143723 A1 * 6/2013 Bender ..... A63B 21/0552 482/121
2013/0327339 A1 * 12/2013 Chua ..... A61G 13/04 128/845
2013/0333116 A1 * 12/2013 West ..... A61F 5/3776 5/623
2014/0150803 A1 * 6/2014 Gold ..... A61G 99/00 128/845
2015/0305962 A1 * 10/2015 Noel ..... A61H 1/0229 602/36
2016/0228320 A1 * 8/2016 Mabry ..... A61H 1/0229

OTHER PUBLICATIONS

High Sierra backpack, Suspension Strap System (photos).

* cited by examiner

STRAP FOR INVERSION THERAPY TABLE

This application claims priority to U.S. provisional patent application Ser. No. 62/245,157, filed Oct. 22, 2015 and is hereby incorporated by reference herein.

BACKGROUND

Field of the Invention

Generally, the present invention relates to a strap for an inversion therapy table that may provide relief for the user's ankles and lower legs while inverting as well as providing a safety measure to help prevent serious injury, in the event that the user shifts, slips or falls out of the inversion table.

Description of Related Art

Inversion therapy involves lying flat on your back at an angle or hanging upside down, in head-down position. Current inversion therapy tables rely on the user's ankles and lower legs to hold the user in place while inverting and during inversion therapy. During inversion, the body weight shifts towards the upper body at the downward position, which can cause discomfort or pain, particularly to the ankles. In addition, users who do not properly lock their ankles into place prior to inverting risk slipping or falling off the inversion table. This risk is increased for new users who are not familiar with inversion tables.

Current inversion therapy tables do not have a mechanism to help reduce the pressure applied to the ankles and lower legs while inverting. Current inversion therapy tables also do not have adequate security measures to help prevent or reduce the likelihood of slipping or falling out of the table.

One inversion table, the TruBalance Synergy NL Pro Deluxe Inversion Table, provides a single cross body strap for the user. However, the upper strap (nearest the user's upper body) passes around the side of the table rather than an area above the user's shoulder. The shoulder is a preferred area to support the user's body weight when in an inverted position. Thus, it is not apparent that the single strap would be able to retain the user on the table in the event of a slip or fall due to the mounting point of the upper strap. Moreover, only a single strap is provided. Because a single strap only supports one side of the user's body, the single strap would provide uneven pressure on the user and therefore is not a preferred way to support the user during inversion therapy to relieve pressure on the user's ankles.

The strap on the TruBalance table is adjustable, but the strap does not provide any markings to denote where the user has adjusted the strap length. As a result, the user cannot easily confirm whether the strap length has been adjusted since a prior use of the table or be able to adjust the strap to a prior preferred length. The strap also does not have any sort of elastic section to provide for a steady inversion and reduce shock from the strap if the user were to slip on the table.

The present disclosures address at least some of the issues described above.

SUMMARY OF THE INVENTION

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

The embodiments herein provide for a method, system and apparatus wherein a strap is attached to a table. The strap may support the user to provide both safety and comfort. The strap is configured such that it may support the user's shoulder while the user is inverted on the inversion table. In the event the user shifts or slips on the inversion table, the strap may support the user to prevent him from sliding or falling out of the inversion table. One embodiment utilizes two straps to support both user's shoulders. The strap may also be adjusted to support a portion of the user's weight, which decreases pressure on the user's ankles and lower legs when using the inversion table. This can make use of the inversion table a more comfortable experience. The strap may also be adjusted so that the user wears the strap but none of the user's body weight is supported by the strap during inversion therapy. This provides the user with the inversion therapy experience provided by the prior art inversion tables but with the added benefit of safety in the event the user were to slip on the table.

The strap may further include additional features to enhance the user experience. The strap may be adjusted to different lengths via a length adjuster. The strap may have visual length markers so that the adjustments provide even support to the user and are repeatable. Examples of such markers include numbered lines or colored lines, symbols, or a combination thereof. The strap may include a releasable connection, such as a buckle, to allow the user to more quickly wear or remove the strap. The strap may also include an elastic band to provide the user with a steady inversion as the user's weight shifts as well as reduce shock from the strap if the user slips or falls on the table.

While the invention is discussed in the context of inversion tables, the strap may also be used on any exercise equipment wherein the user will be in an inverted position, e.g. the user's head is lower than the user's hips. For example, the strap of the present invention could be attached to a weight lifting bench that has an adjustable surface such that the user is in an inverted position.

BRIEF DESCRIPTION OF THE FIGURES

The disclosed subject matter will hereafter be described with reference to the accompanying drawings, wherein like reference numerals denote like elements, and.

Figure 1:
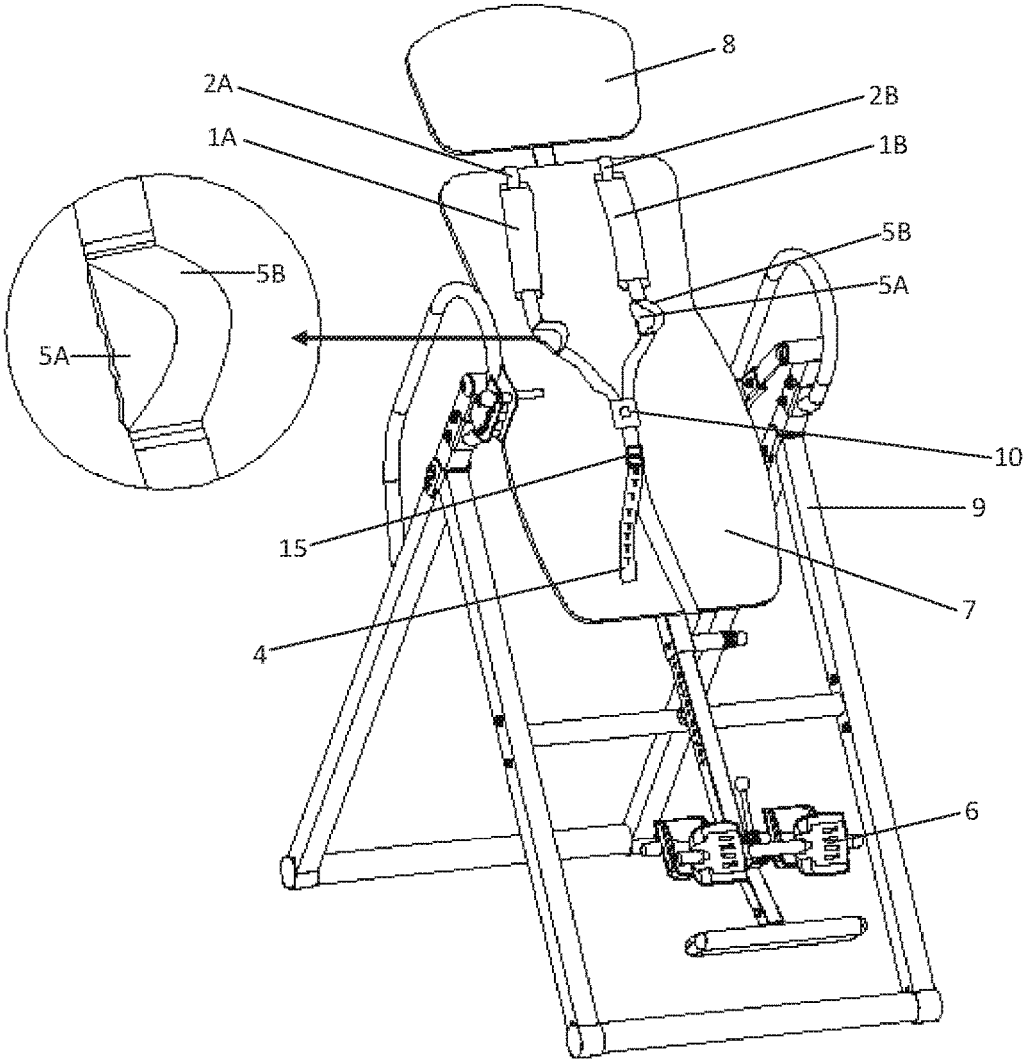
FIG. 1 provides a perspective view of an inversion table with a strap in accordance with some embodiments of the present invention.

While the disclosed subject matter is susceptible to various modifications and alternative forms, specific embodiments thereof have been shown by way of example in the drawings and are herein described in detail. It should be understood, however, that the description herein of specific embodiments is not intended to limit the disclosed subject matter to the particular forms disclosed, but on the contrary, the intention is to cover all modifications, equivalents, and alternatives falling within the spirit and scope of the disclosed subject matter as defined by the appended claims.

DETAILED DESCRIPTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 2:
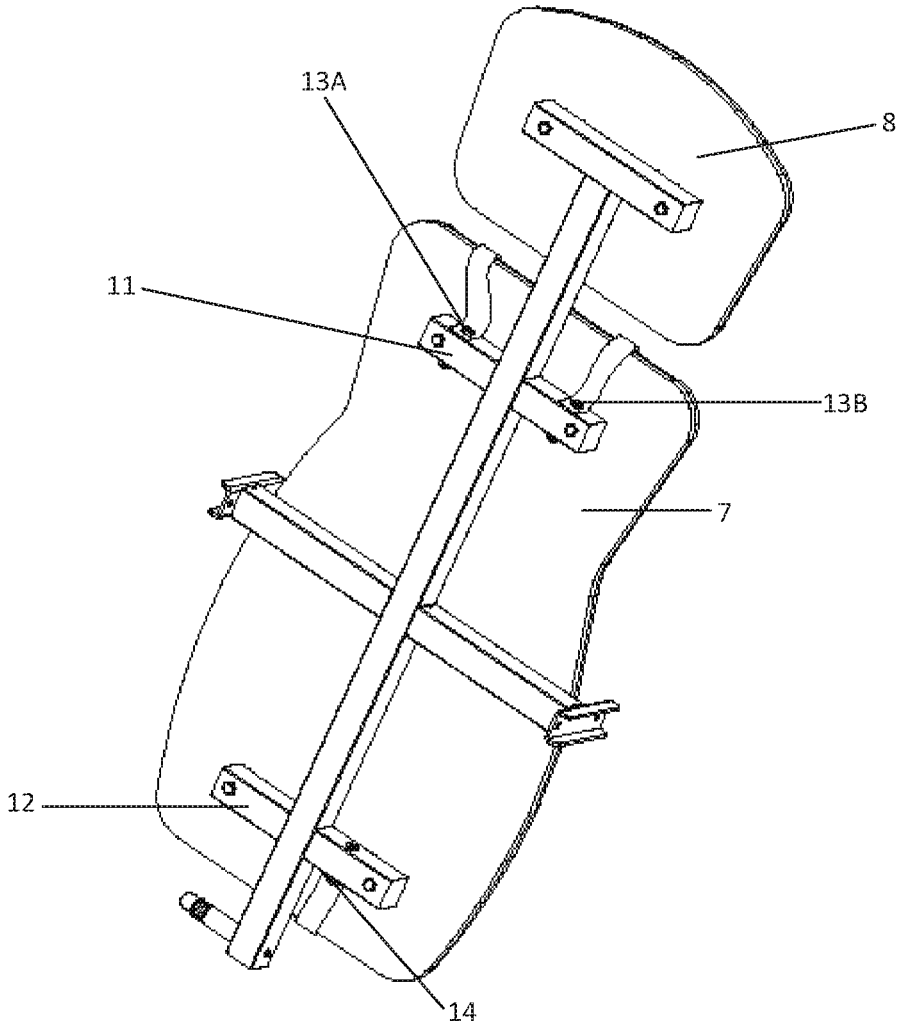
FIG. 2 provides a perspective view of the rear of the backrest and headrest sections of the inversion table showing an exemplary type of attachment of the strap to the inversion table.
Figure 3:
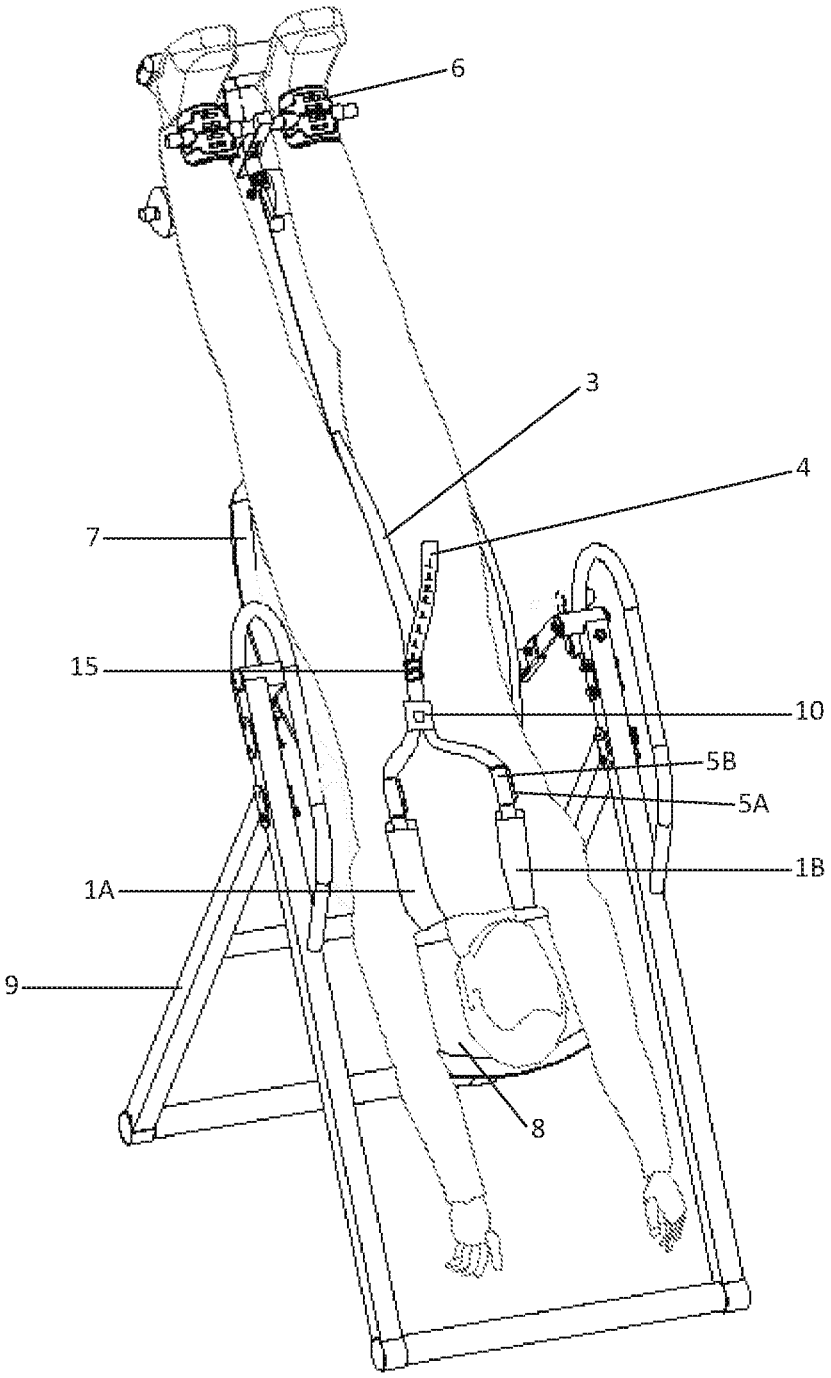
FIG. 3 provides a perspective view of the inversion table with a user during inversion therapy.

With reference to FIGS. 1 to 3, a strap for an inversion table (9) having an ankle lock (6), a backrest (7), and headrest (8) comprises shoulder harnesses (2A, 2B). The shoulder harnesses (2A, 2B) are mounted such that they pass over the user's shoulder area. If the shoulder harnesses (2A, 2B) are too far apart, the user might not be held or restrained by the strap.

One type of attachment of the strap to the inversion table is illustrated in FIG. 2. The upper end of each shoulder harness (2A, 2B) is attached to a horizontal upper support beam (11) on the rear surface of the backrest (7) by bolts (13A, 13B). From the upper support beam (11), each shoulder harness (2A, 2B) passes over the top of the backrest (7). The shoulder harness attachment points on the upper support beam (11) are sufficiently close together such that the shoulder harness is located generally above the user's shoulder area. In one embodiment, the distance between these attachments points is in the 8 to 10 inch range. The lower end of one of the shoulder harnesses is attached to a horizontal lower support beam (12) on the rear surface of the backrest (7) by a bolt (14). From the lower support beam (12), the lower end of the shoulder harness passes around the middle portion of the lower end of the backrest (7).

The shoulder harnesses may be attached via other means determined by one of ordinary skill in the art, so long as the upper portions of the shoulder harness pass over the user's shoulder when the strap is worn. For example, the upper end of the shoulder harness could be attached to the side of the upper edge of the backrest or the front surface of the backrest (7) rather than the rear surface configuration shown in FIG. 2. Similarly, the shoulder harnesses could be installed in an V pattern across the user's body, such that one shoulder harness goes across the user's right shoulder and then between the user's legs and another shoulder harness goes across the user's left shoulder and then between the user's legs.

As an alternative to using a separate headrest (8) from the backrest (7), a longer one piece backrest that supports both the user's torso and head may be used. For this configuration, the upper ends of the shoulder harnesses (2A, 2B) may be mounted to the front surface of the backrest. Alternatively, the backrest may include holes or slots for the shoulder harnesses (2A, 2B) located above or behind the user's shoulder such that the upper ends of the shoulder harnesses may be attached to the rear of the backrest, as shown in FIG. 2, and pass through the holes or slots to the front of the backrest. So long as the upper ends of the shoulder harnesses are attached in a manner that they pass over the user's shoulders, the upper ends of the shoulder harnesses are considered to be connected to a first end of the backrest.

The lower end of one of the shoulder harnesses shown in FIG. 2 is attached such that it passes around the middle portion of the lower end of the backrest. Attached in this manner, the lower portion of the shoulder harness passes between the user's legs, as shown in FIG. 3. So long as the lower end of the shoulder harness is attached to the backrest in a manner that it pass between the user's legs, the lower end of the shoulder harness is considered to be connected to a middle portion of the second end of the backrest.

A shoulder harness may include a length adjuster (15) so that the user can adjust the length of the shoulder harnesses. Examples of adjusters are strap adjusters found on camera bag straps. The length adjuster (15) allows users to control the relief/pressures on their ankles. While inverting with the strap, the pressure is redirected and applied to the user's shoulders. By tightening the straps and shortening the adjustable shoulder harnesses, the pressure on the feet is lessened, but the full benefits of the inversion therapy are also lessened. However, by using inversion therapy in this stage, the user can strengthen their ankle muscles and slowly allow the ankles to withstand pressure without discomfort. By loosening the adjustable shoulders straps, the user is able to receive more of the full benefits of inversion therapy, although loosening the shoulder harnesses applies more pressure on the user's lower legs. The user can also adjust the strap so that it is worn loosely, such that none or very little of the user's weight is supported by the straps during inversion therapy. In this manner, the user may engage in traditional inversion therapy while still retaining the safety benefits of the strap.

The strap may include visual length markers of any length adjustments of the shoulder harness. Visual length markers may include numbered lines (4), letters, differently colored lines or circles, or a combination thereof. The visual length markers allow the user to adjust the straps evenly in order to avoid uneven straps, which can cause an unbalanced relief and/or extra pressure on one ankle. Thus, the visual indications help ensure the pressure relief on both ankles is balanced.

Each shoulder harness (2A, 2B) may include an elastic band (5A) that is attached at each end along the length of the shoulder harness. See the enhanced view of this configuration in FIG. 1. The attachment may be accomplished by sewing the end of the elastic band to the shoulder harness. The elastic band (5A) has a length in its unstretched state and a maximum stretched length. The elastic band is attached to the shoulder harness (5B) such that the distance along the shoulder harness between the band attachment points is greater than the unstretched length of the band and less than the maximum stretched length of the band. Accordingly, when the elastic band is not stretched, the shoulder harness adjacent the band will be shortened, forming a loop. As the elastic band is stretched, the shoulder harness adjacent to the band will gradually straighten until it completely straightens, at which point the elastic band will not stretch any farther. While inverting, the elastic bands assist by slowly easing the user down the inversion table and allows for a more steady inversion. Thus, the bands (5A) may provide a smoother inversion.

The shoulder harnesses (2A, 2B) may include cushions (1A, 1B) positioned over the user's shoulder while the strap is in use to provide the user with additional comfort. The cushions (1A, 1B) are moveable on the shoulder harnesses (2A, 2B) so that the user can adjust where the cushions are positioned. The cushions may be made of any soft, flexible material, such as foam and/or thick cloth.

The shoulder harnesses (2A, 2B) may be made of any weight supporting material, such as nylon.

The particular embodiments disclosed above are illustrative only, as the disclosed subject matter may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the disclosed subject matter. Accordingly, the protection sought herein is as set forth in the claims below.

What is claimed is:

1. A strap for a table having a backrest having a first end and a second end, wherein the first end is proximate a user's head and the second end is distal to the user's head, the second end having a middle portion the inversion table configured to pivot and invert the user such that the user's ankles are vertically above the user's head, the strap comprising:

a first end and a second end, the first end for connecting to the first end of the backrest and the second end for connecting to the middle portion of the second end of the backrest, a releasable connection on the first strap in between the first end and second end of the first strap, and a second strap having a first end and a second end, the first end for connecting to the first end of the backrest and the second end connected to the releasable connection, wherein the first and second straps are configured to support the user's shoulders, provide relieve for the user's ankles and lower legs while inverting, as well as provide a safety measure to help prevent injury in the event the user shifts, slips, or falls out of the inversion table.

2. The strap of claim 1, wherein the first end of the first strap and the first end of the second strap are proximately attached to the first end of the backrest.

3. The strap of claim 1, wherein the first strap includes a length adjuster.

4. The strap of claim 3, wherein the first strap includes visual length markers adjacent the length adjusters.

5. The strap of claim 1, wherein the first strap includes a cushion located near the first end of the strap.

6. The strap of claim 1, further comprising an elastic band having a first end and a second end and having an unstretched length and a maximum stretched length, wherein the first end and second end of the elastic band are connected along the length of the first strap at a first connection point and a second connection point such that the distance between the first and second connection points of the elastic band to the first strap are greater than the unstretched length of the elastic band and less than the maximum stretched length of the elastic band.

7. A table having a first strap and a backrest, wherein:

the backrest has a first end and a second end, wherein the first end is proximate a user's head and the second end is distal to the user's head, the second end having a middle portion, the inversion table configured to pivot and invert the user such that the user's ankles are vertically above the user's head;

the first strap has a first end and a second end, the first end for connecting to the first end of the backrest and the second end for connecting to the middle portion of the second end of the backrest, a releasable connection on the first strap in between the first end and second end of the first strap, and a second strap having a first end and a second end, the first end for connecting to the first end of the backrest and the second end connected to the releasable connection, wherein the first and second straps are configured to support the user's shoulders, provide relieve for the user's ankles and lower legs while inverting, as well as provide a safety measure to help prevent injury in the event the user shifts, slips, or falls out of the inversion table.

8. The table of claim 7, further comprising the first end of the first strap and the first end of the second strap are proximately attached to the first end of the backrest.

9. The table of claim 7, wherein the first strap includes a length adjuster.

10. The table of claim 9, wherein the first strap includes visual length markers adjacent the length adjusters.

11. The table of claim 7, wherein the first strap includes a cushion located near the first end of the strap.

12. The table of claim 7, further comprising an elastic band having a first end and a second end and having an unstretched length and a maximum stretched length, wherein the first end and second end of the elastic band are connected along the length of the first strap at a first connection point and a second connection point such that the distance between the first and second connection points of the elastic band to the first strap are greater than the unstretched length of the elastic band and less than the maximum stretched length of the elastic band.

13. An inversion table comprising:

a backrest having a first end and a second end, wherein the first end is proximate a user's head and the second end is distal to the user's head, the second end having a middle portion, the inversion table configured to pivot and invert the user such that the user's ankles are vertically above the user's head;

a first strap having a first end and a second end, the first end for connecting to the first end of the backrest and the second end for connecting to the middle portion of the second end of the backrest;

a releasable connection on the first strap in between the first end and second end of the first strap;

a second strap having a first end and a second end, the first end for connecting to the first end of the backrest and the second end connected to the releasable connection, wherein the first and second straps are configured to support the user's shoulders, provide relieve for the user's ankles and lower legs while inverting, as well as provide a safety measure to help prevent injury in the event the user shifts, slips, or falls out of the inversion table;

the first end of the first strap and the first end of the second strap are proximately attached to the first end of the backrest;

a first elastic band having a first end and a second end and having an unstretched length and a maximum stretched length, wherein the first end and second end of the elastic band are connected along the length of the first strap at a first connection point and a second connection point such that the distance between the first and second connection points of the elastic band to the first strap is greater than the unstretched length of the first elastic band and less than the maximum stretched length of the first elastic band; and a second elastic band having a first end and a second end and having an unstretched length and a maximum stretched length, wherein the first end and second end of the elastic band are connected along the length of the second strap at a first connection point and a second connection point such that the distance between the first and second connection points of the elastic band to the second strap is greater than the unstretched length of the second elastic band and less than the maximum stretched length of the second elastic band.

* * * * *